US006897623B2

(12) United States Patent
Yoneda et al.

(10) Patent No.: US 6,897,623 B2
(45) Date of Patent: May 24, 2005

(54) ELECTRIC POWER SUPPLY SYSTEM FOR LED LIGHTING UNIT

(75) Inventors: Kenji Yoneda, Kyoto (JP); Tomomi Iwata, Kyoto (JP); Masahiro Wakata, Kyoto (JP)

(73) Assignee: CCS, Inc., Kyoto (JP)

( * ) Notice: Subject to any disclaimer, the term of this patent is extended or adjusted under 35 U.S.C. 154(b) by 44 days.

(21) Appl. No.: 10/686,234

(22) Filed: Oct. 15, 2003

(65) Prior Publication Data

US 2004/0090189 A1 May 13, 2004

(30) Foreign Application Priority Data

Oct. 16, 2002 (JP) ..... P2002-302071

(51) Int. Cl.[7] ..... H05B 37/00
(52) U.S. Cl. ..... 315/291; 315/119; 315/185 R
(58) Field of Search ..... 315/119, 185 R, 315/291, 224; 363/21.15, 21.17

(56) References Cited

U.S. PATENT DOCUMENTS

| | | | | |
|---|---|---|---|---|
| 5,861,729 A | | 1/1999 | Maeda et al. | 320/106 |
| 6,033,087 A | * | 3/2000 | Shozo et al. | 362/244 |
| 6,122,042 A | * | 9/2000 | Wunderman et al. | 356/73 |
| 6,281,991 B1 | | 8/2001 | Mori et al. | 358/475 |
| 6,400,101 B1 | * | 6/2002 | Biebl et al. | 315/291 |
| 6,577,512 B2 | | 6/2003 | Tripathi et al. | 363/21.17 |

FOREIGN PATENT DOCUMENTS

| | | |
|---|---|---|
| DE | 100 51 528 | 5/2002 |
| EP | 1 244 334 | 9/2002 |
| WO | WO 02/03524 | 1/2002 |

* cited by examiner

*Primary Examiner*—David Vu

(57) ABSTRACT

An electric power supply system is provided to recognize a type or a desired operating condition of a connected LED lighting unit automatically and to supply electric power corresponding to the type or the operating condition.

An electric power supply system for LED lighting unit comprises an LED lighting unit 1 that has an LED conducting circuit including at least an LED 2 and a resistor 4 having resistance R corresponding to a specification or a characteristics of use of the LED conducting circuit and an electric power supply unit 5 consisting of a constant current supply that can be connected with both ends of the LED conducting circuit in order to supply electric power to the LED conducting circuit and is so arranged that a type identify portion 9 consisting of a resistor measuring circuit that can be connected with both ends of the resistor and a constant current control portion 8 that supplies a control current in an arbitrary range not over the maximum allowable current of the LED conducting circuit set based on the resistance of the resistor measured by the type identify portion 9 to the LED conducting circuit.

9 Claims, 13 Drawing Sheets

ELECTRIC POWER SUPPLY SYSTEM FOR LED LIGHTING UNIT

BACKGROUND OF THE INVENTION AND RELATED ART STATEMENT

The present claimed invention relates to an electric power supply system for LED lighting unit suitable for lighting for varieties of optical inspections or mark reading.

Recently LED lighting units have been in heavy usage for optical lighting in order to inspect a fine flaw on a surface of an object or to read a sign such as an alignment mark in accordance with improvement of LED performance. Since each of the LED lighting units varies in a characteristics, an arrangement and a number of an LED element in compliance with its purpose, the LED lighting unit is connected with an electric power supply unit that meets a requirement of a current and a voltage of the LED lighting unit. Further, in case an adjustment range is lowered in use, if the electric power supply unit is used in a rated condition of use without change, there is a problem such that a fine control is difficult.

Generally an electric input connector of a same size specification or an electric output-connector of the same size specification that coincides with the electric input connector is attached to the LED lighting unit and a constant current supply unit respectively in a step of manufacturing the LED lighting unit and the constant current supply unit. The electric power supply unit is desired to verify and set a range to meet a rated condition of use of the LED lighting unit to be used. However, this procedure is troublesome and there is a possibility that time is wasted or malfunction is occurred due to a wrong setting of the range.

There was a technique as described in the following patent document 1 to verify a combination of the lighting unit and the electric power supply unit after connected whether the combination was appropriate or not.

(Patent Document 1)

Patent Laid Open No. 6-94627(Japan)

However, the lighting unit described in the patent document 1 uses an electric filament lamp such as a halogen lamp as a light source and is so arranged that a current considerably smaller than a rated value is passed through the electric power supply unit so as not to actuate the electric filament lamp practically and the light source is specified by measuring resistance peculiar to the filament and then a voltage and a current corresponding to the light source is set. As a result, the technique cannot be applied to the LED because resistance becomes almost zero when a current passes forward.

Varieties of LED lighting units, especially for inspecting an appearance of an article, have been developed in accordance with an LED made to be super powerful and improvement in a range and selectivity of an emission wave length and an electric power supply unit for supplying electric power to the LED systems has also been developed. Accordingly, a proper lighting unit should be selected and combined with a proper electric power supply unit (or an electric power supply tap) in order to obtain appropriate lighting which might otherwise be a cause of malfunction or trouble.

The present claimed invention intends to provide an electric power supply system for LED lighting unit that can recognize a type or a desired operating condition of a lighting unit automatically and supply electric power corresponding to the type or the operating condition when the lighting unit using the LED is connected to a predetermined electric power supply unit.

In case of a conventional LED lighting unit, the present claimed invention further intends to provide an electric power supply system for LED lighting unit that can recognize a type or a desired operating condition of a lighting unit automatically and supply electric power corresponding to the type or the operating condition by being equipped with a simple additional mechanism so as to exemplify a technical idea when the conventional LED lighting unit is connected to a predetermined electric power supply unit.

SUMMARY OF THE INVENTION

As a fundamental form to solve the above problems, an electric power supply system for LED lighting unit in accordance with the present claimed invention described in claim 1 constitutes a work imaging system to take an image of a work as an object to be taken by an imaging device such as a CCD camera and to process the image so as to inspect a flaw formed on a surface of the work or to read a mark such as an alignment mark, and is characterized by comprising an LED lighting unit that has an LED conducting circuit including at least an LED and a resistor for type identification having resistance corresponding to a specification or a characteristics of use of the LED conducting circuit and that irradiates light on the work and an electric power supply unit that has a type identify portion consisting of a resistor measuring circuit that can be connected with the resistor for type identification and a constant current control portion that supplies a control current in an arbitrary range not over the maximum allowable current of the LED conducting circuit set based on the resistance of the resistor for type identification measured by the type identify portion to the LED conducting circuit.

It is a matter of course that the present claimed invention can be applied to other than the work imaging system. In this case, it is preferable to comprise an LED lighting unit that has an LED conducting circuit including at least an LED and a resistor for type identification having resistance corresponding to a specification or a characteristics of use of the LED conducting circuit and an electric power supply unit that consists of a constant current power supply that can be connected with the LED conducting circuit to supply electric power to the LED conducting circuit of the LED lighting unit and that has a type identify portion consisting of a resistor measuring circuit that can be connected with both ends of the resistor for type identification and a constant current control portion that supplies a control current in an arbitrary range not over the maximum allowable current of the LED conducting circuit set based on the resistance of the resistor for type identification measured by the type identify portion to the LED conducting circuit.

Further as another form to solve the above problems the electric power supply system for LED lighting unit in accordance with the present claimed invention described in claim 3 is characterized by comprising an LED lighting unit that has an LED conducting circuit including at least an LED and a resistor for type identification having resistance corresponding to a specification or a characteristics of use of the LED conducting circuit and connected with the LED conducting circuit in parallel and an electric power supply unit consisting of a constant current supply unit that can be connected with the LED conducting circuit in order to supply electric power to the LED conducting circuit of the LED lighting unit and that comprises a type identify portion to measure resistance of the resistor for type identification by impressing a measure voltage of a level that does not affect an operation of the LED conducting circuit to the resistor for type identification connected with the LED conducting circuit for an extremely short time, a constant current control portion that supplies a control current in an arbitrary range not over the maximum allowable current of the LED conducting circuit set based on the resistance of the resistor for type identification that is connected in parallel that is measured by the type identify portion to the LED conducting circuit after the measure voltage is impressed, and a breaking of wiring identify portion that monitors a condition of electric power supply/a connecting condition between the LED lighting unit and the electric power supply unit and that reboots the type identify portion when the condition of electric power supply/the connecting condition is broken.

As mentioned above, in case an adjustment range is lowered in use, if the electric power supply unit is used in a rated condition of use without change, there is a problem such that a fine control is difficult.

In order to solve this problem effectively, it is preferable that the electric power supply system for LED lighting unit further comprises a light control signal receive portion that receives a light control signal and a range switch portion that can be switched to at least two states, an ordinary state and a low electric power consumption state and is so arranged that the constant current control portion supplies a control current corresponding to a value of a received light control signal to the LED conducting circuit, and in case the range switch portion is switched to the ordinary state, a control current having the maximum allowable current is supplied to the LED conducting circuit when a value of the received light control signal is the maximum, meanwhile in case the range switch portion is switched to the low electric power consumption state, a control current smaller than the maximum allowable current is supplied to the LED conducting circuit even though a value of the received light control signal is the maximum.

Practically resistance of a resistor varies widely. Then in case the maximum allowable current is determined based on resistance with considering a permissible variation, it is preferable that the maximum allowable current corresponding to a range is set whether the resistance is within the predetermined range or not. As a result, it is preferable that the maximum allowable current is set in a graded manner based on the resistance of the resistor for type identification.

BRIEF DESCRIPTION OF THE DUNITINGS

DETAILED DESCRIPTION OF THE PREFERRED EMBODIMENTS

Figure 8:
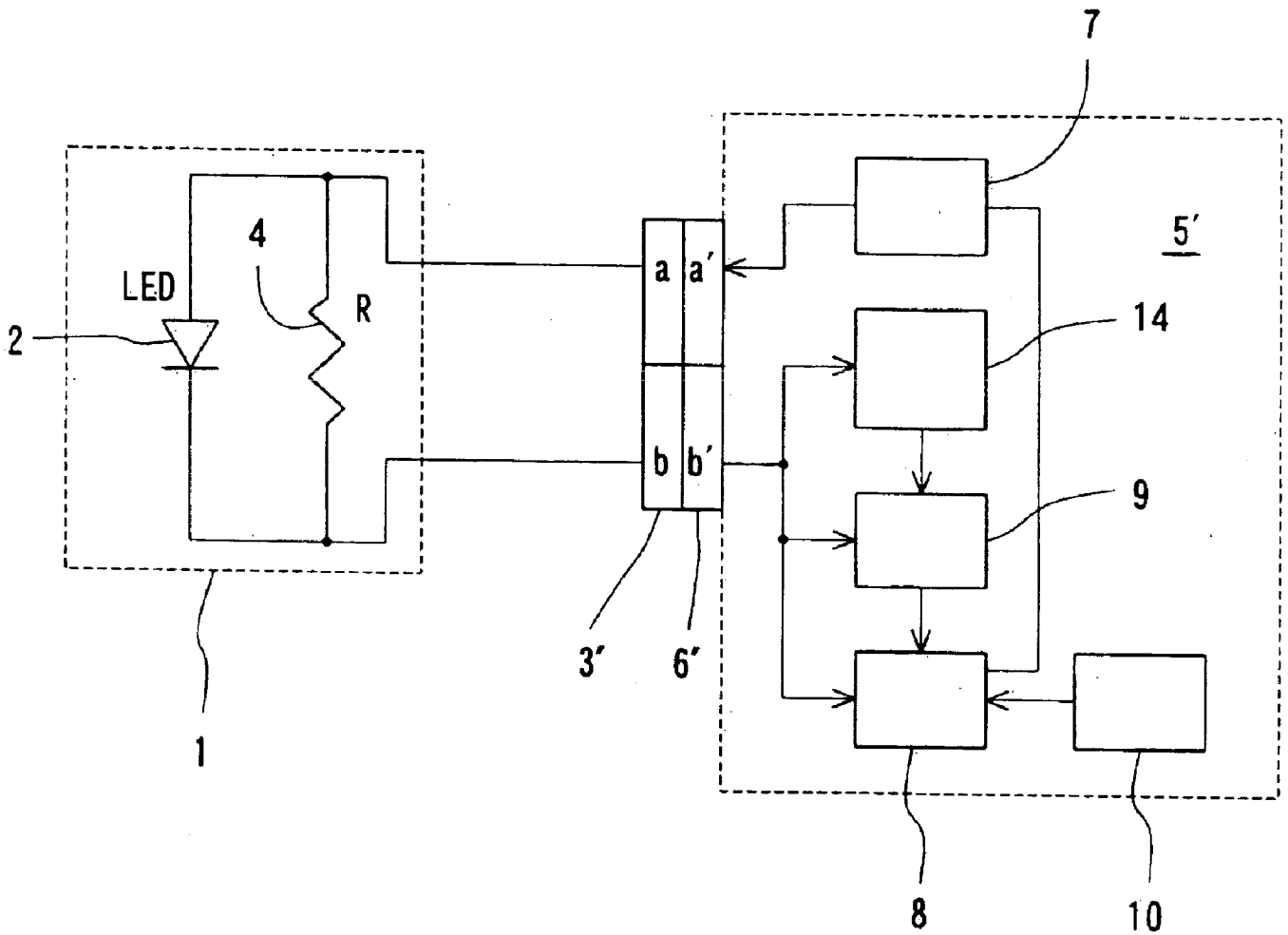
FIG. 8 is a diagram showing a second embodiment of the present claimed invention.
Figure 9:
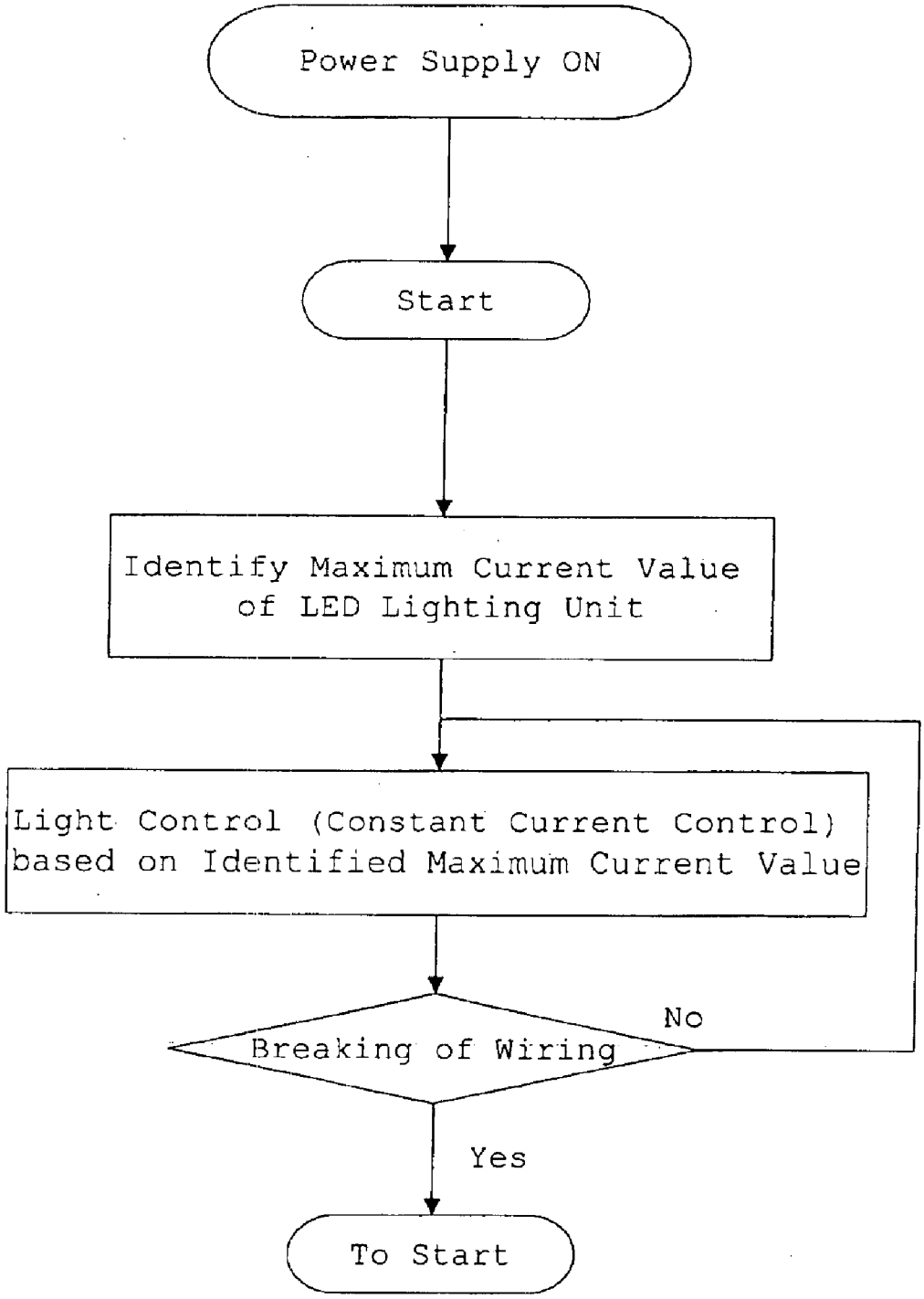
FIG. 9 is an operating flow chart in the second embodiment.
Figure 10:
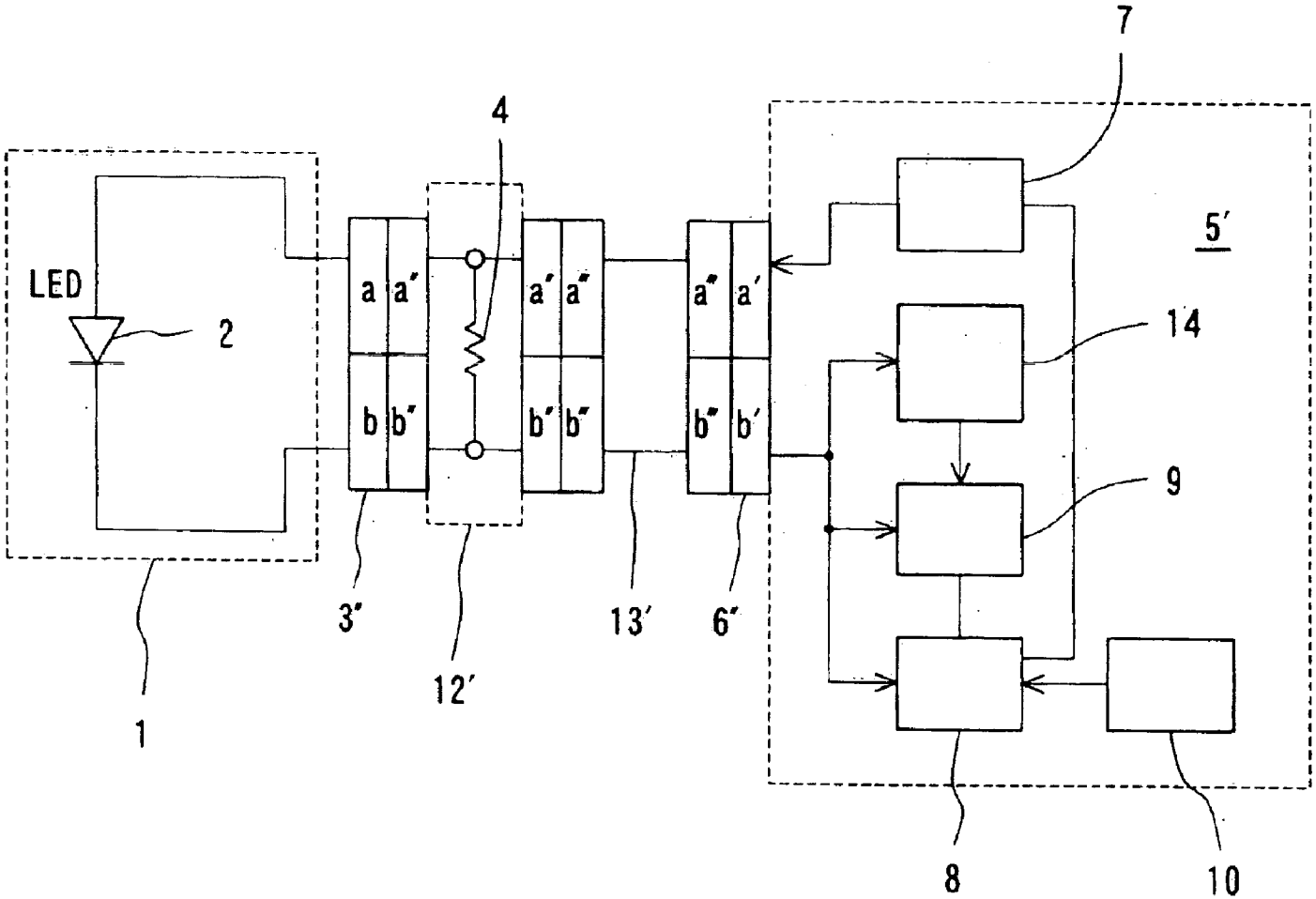
FIG. 10 is a diagram showing a form of a case that an adapter is arranged in the second embodiment.
Figure 11:
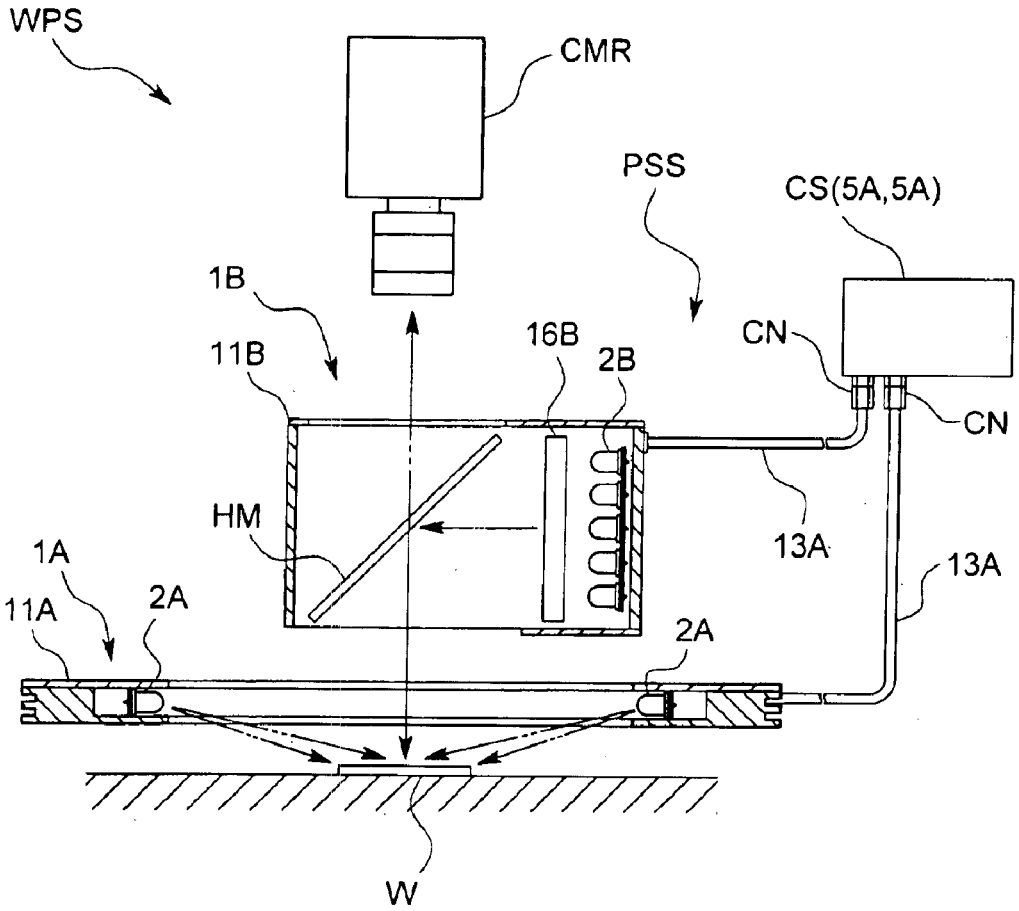
FIG. 11 is a pattern diagram showing a work imaging system including an electric power supply system for LED lighting unit in accordance with the third embodiment of the present claimed invention.
Figure 12:
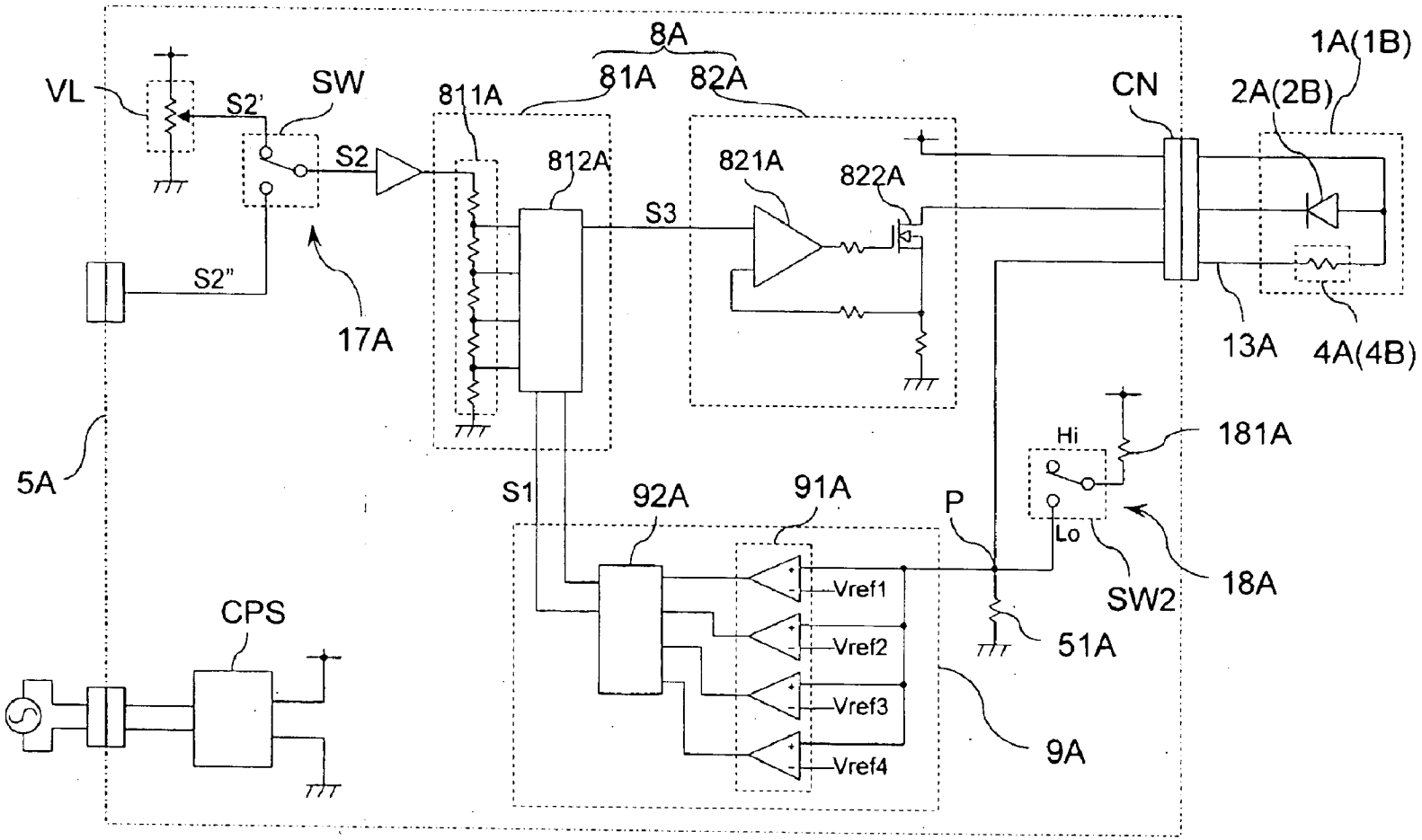
FIG. 12 is a pattern block diagram showing the electric power supply system for LED lighting unit in the third embodiment.

Preferred embodiments of the present claimed invention will be described with reference to the drawings. FIG. 1 through FIG. 7 show a first embodiment in accordance with a basic form of the present claimed invention, FIG. 8 through FIG. 10 show a second embodiment in accordance with another form of the present claimed invention and FIG. 11 through FIG. 12 show a third embodiment in accordance with the present claimed invention respectively.

Figure 1:
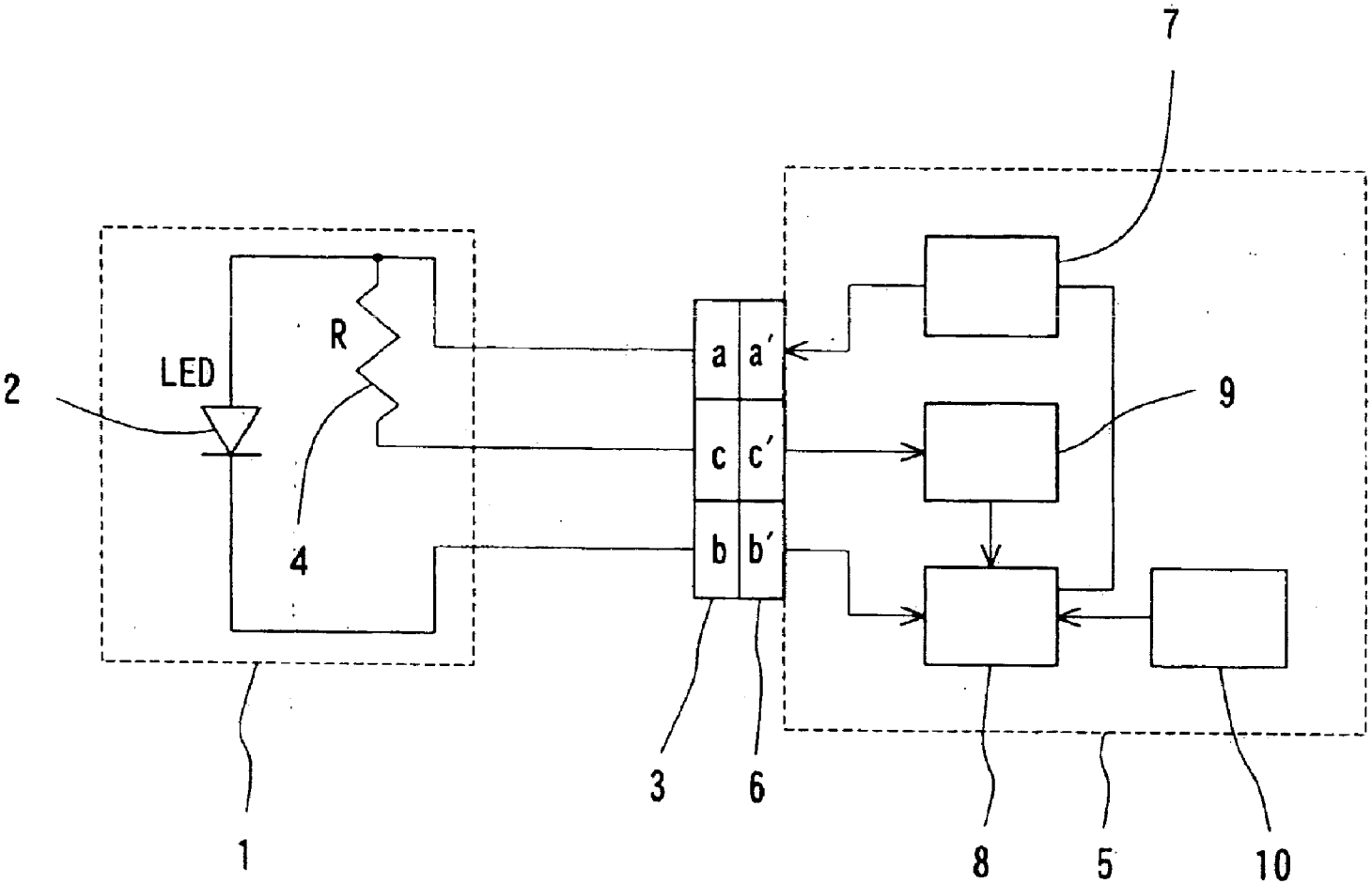
FIG. 1 is a diagram showing a first embodiment as a basic form of the present claimed invention.

In the first embodiment shown in FIG. 1, an LED lighting unit 1 comprises an LED conducting circuit that includes an LED 2 and that terminates at terminals a and b of, for example, a terminal unit 3 consisting of an electric power supply input connector and a resistor for type identification 4 that has resistance R corresponding to a specification or a characteristics of use of the LED conducting circuit. The resistor for type identification 4 is inserted between one end of the LED conducting circuit, namely an anode side a of the LED and another terminal c of the terminal unit 3 (hereinafter called "resistor terminal c), but may be electrically separated from the LED conducting circuit like an example to be described later. The resistor for type identification 4 can be used to switch a condition of use (a range of an optical output level) of the LED lighting unit 1 as a variable resistor or a resistor of a tap switch-type.

Figure 2:
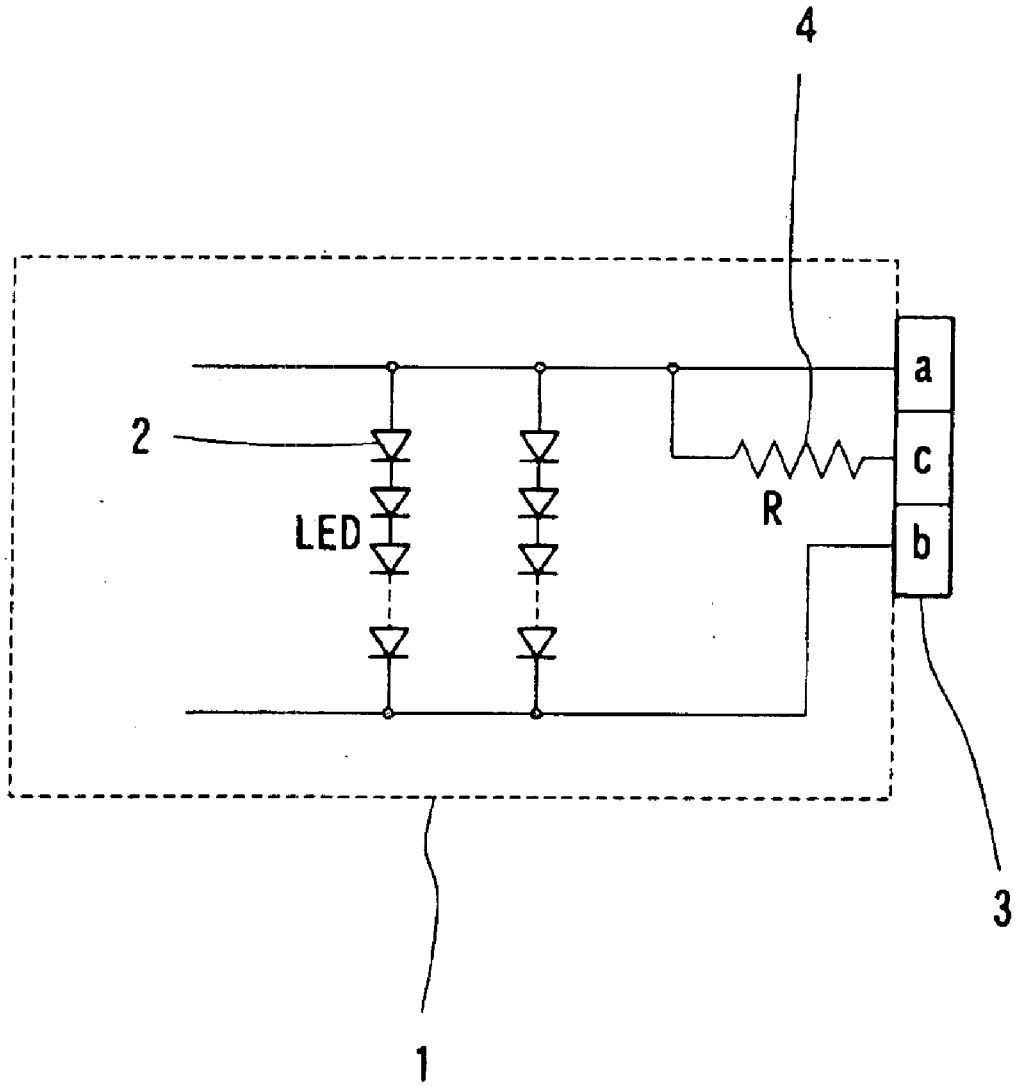
FIG. 2 is a circuit diagram showing an example of a case that an LED conducting circuit has a plurality of LEDs in accordance with the first embodiment.

The LED 2 can be so arranged, for example, as shown in FIG. 2, that a necessary number of elements are connected in series or in parallel so as to pass a rated current through each element in accordance with a setting of optical output of the LED lighting unit 1. The arrangement of the LED conducting circuit including a plurality of LEDs may be used for any embodiment to be described later.

Figure 3:
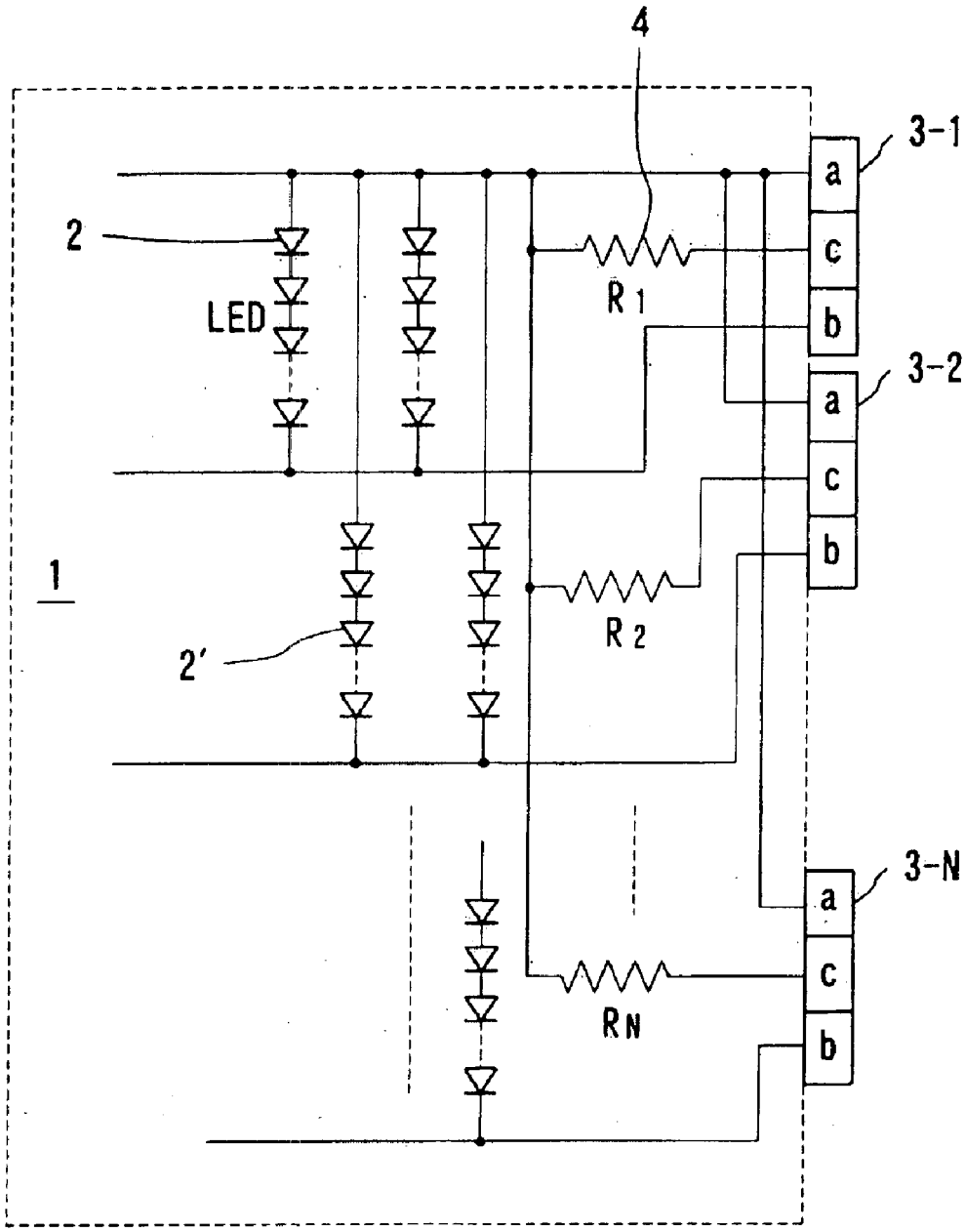
FIG. 3 is a circuit diagram showing a modified form of the multiplexed or hybrid LED conducting circuit in accordance with the first embodiment.

Further, for the LED lighting unit 1 as shown in FIG. 3, in accordance with the setting of an optical output or a wave length, a necessary number of the LED conducting circuits can be prepared and each of a corresponding resistor for type identification R1, R2, . . . is connected to each of the LED conducting circuit respectively so as to multiplex or hybrid the combinations of each terminal 3-1, 3-2, . . . 3-N such that combinations of each terminal 3-1, 3-2, . . . 3-N are placed side by side. Each of the LED conducting circuit may be so arranged that one end (in this embodiment, a side) is connected to a common line as shown in FIG. 3, or may be completely separated. It is a matter of course that a number of the LED is different from a number of the LED conducting circuit.

An electric power supply unit 5 for supply electric power to the LED conducting circuit of the LED lighting unit 1 comprises, as shown in FIG. 1, a terminal unit 6 consisting of, for example, an output connector including a pair of electric power supply terminals a' and b' that can be connected with both ends of the LED conducting circuit, the terminals a and b of the input terminal unit 3 in this embodiment, a constant voltage power supply portion 7 that is connected with the electric power supply terminal a', a constant current control portion 8 that is connected with the electric power supply terminal b' and a type identify portion 9 that is connected with a measuring input terminal that is connected with an intermediate terminal c' (hereinafter called "resistor terminal c'") of the output terminal unit 6 that can be connected with the resistor terminal c of the input terminal unit 3. The resistor measuring means is connected with both ends of the resistor for type identification 4 in relation with the constant voltage power supply portion 7 and the constant current control portion 8 and measures resistance R accurately.

Figure 4:
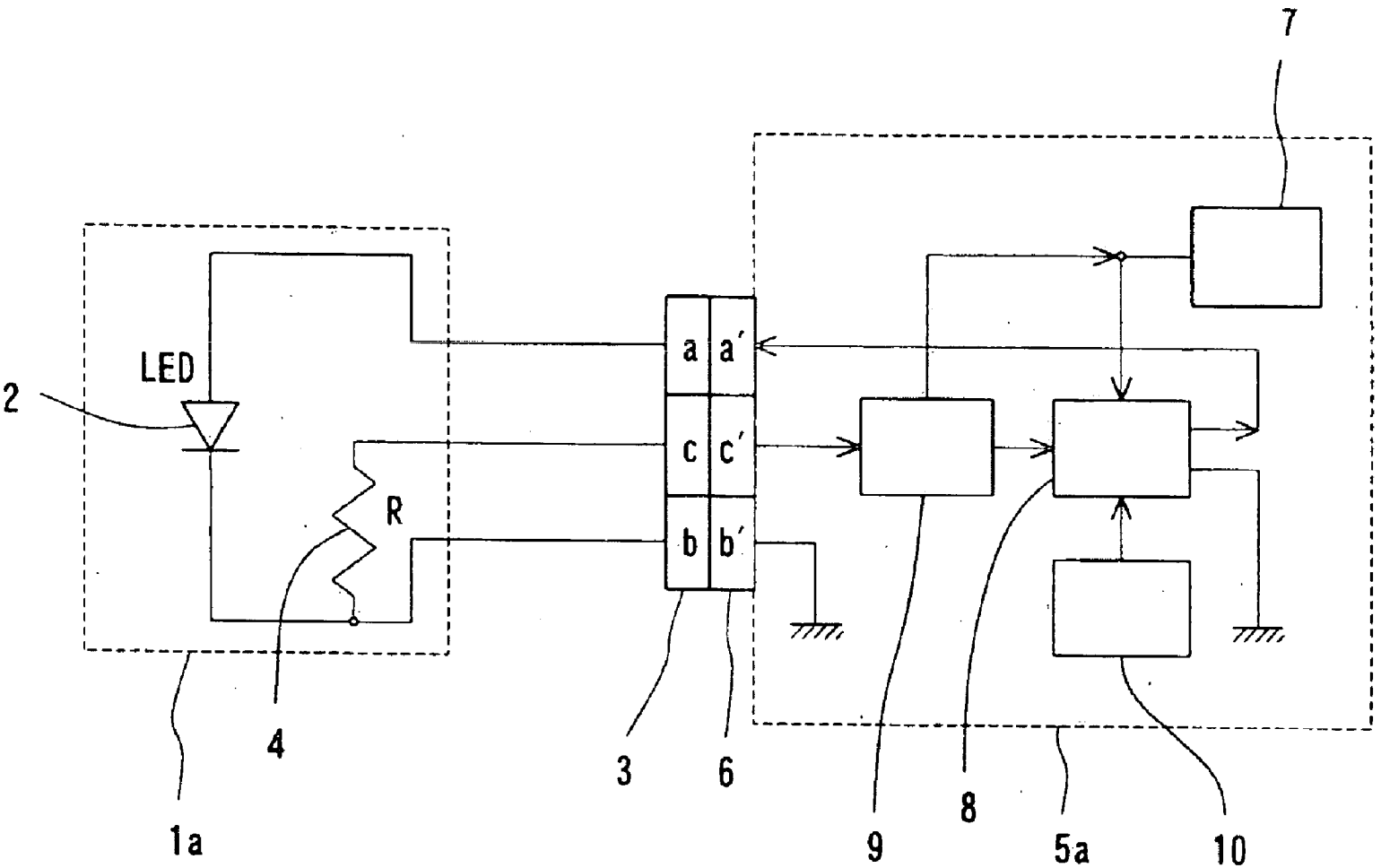
FIG. 4 is a diagram showing another example of a system configuration in the first embodiment.

FIG. 4 shows an example of a system configuration combined with a lighting unit 1*a* wherein the resistor for type identification 4 is connected with a cathode side of the LED 2, namely the terminal c, and an electric power supply unit 5*a* wherein an input/output of the constant current control portion 8 connected with the constant voltage power supply portion 7 is inserted between the electric power supply terminal a' and the electric power supply terminal b' of the output terminal unit 6 and a type identify signal is supplied to not only the constant current control portion 8 but also the constant voltage power supply portion 7. It is a matter of course that the above-mentioned lighting unit 1 and the electric power supply unit 5*a* of this system configuration can be combined or the lighting unit 1*a* of this system configuration and the above-mentioned electric power supply unit 5 can be combined.

Figure 5:
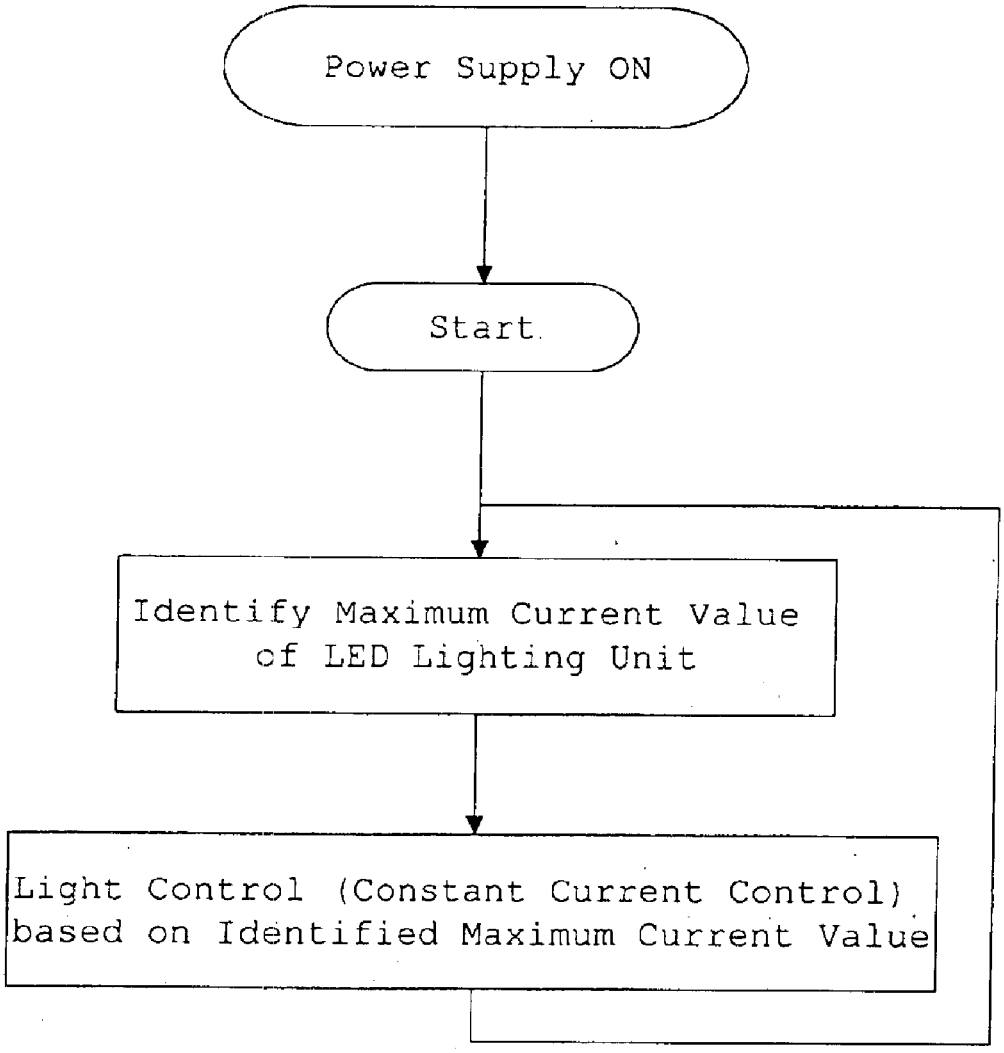
FIG. 5 is an operating flow chart in the first embodiment.

The type identify portion 9 sends a type identify signal and a control signal to the constant current control portion 8 (and the constant voltage power supply portion 7 in the circuit shown in FIG. 4) in accordance with the measured resistance R of the resistor for type identification 4 and the constant current control portion 8 controls the electric power supply circuit of the electric power supply unit 5 so that a control current in an arbitrary range not over the maximum allowable current passes to the LED conducting circuit of the lighting unit 1 through a pair of the electric power supply terminals a' and b'. Further a light control signal 10 is supplied to the constant current control portion 8 so as to obtain an arbitrary optical output level. FIG. 5 shows a summary of the above-mentioned operating flow.

Figure 6:
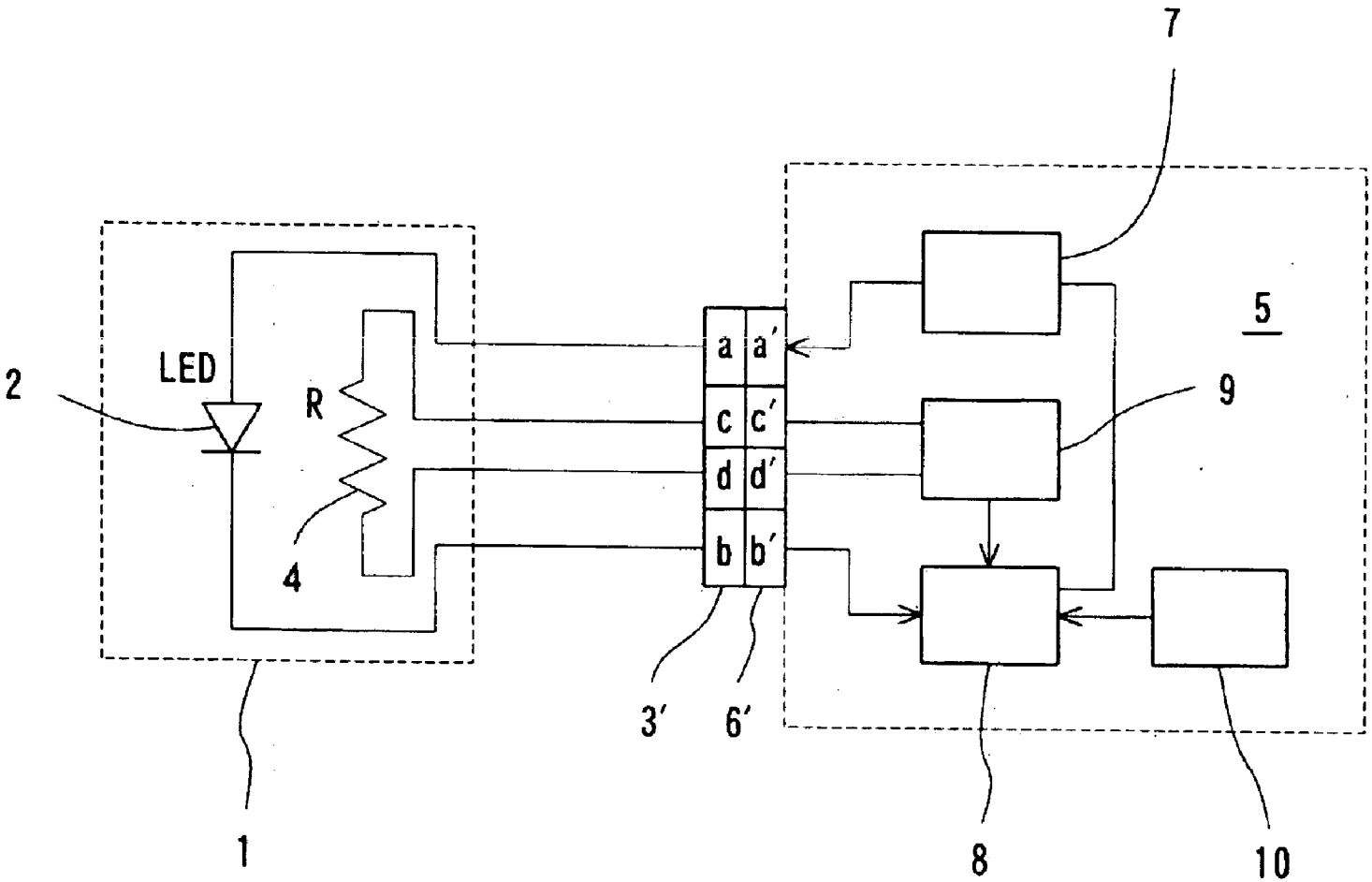
FIG. 6 is a diagram showing a further different modified form in the first embodiment.

As a modified form of the base of the present claimed invention, as shown in FIG. 6, an input terminal unit 3' of a side of the lighting unit 1 is made to be a four-terminal type and the equipped resistor for type identification 4 is connected to insert between a third terminal c and a forth terminal d. The output terminal unit 6' of the electric power supply unit 5 is also made to be a four-terminal type in accordance with the input terminal unit 3' and a third terminal c' and a forth terminal d' of the terminal unit 6' are connected with a resistor measuring input of the type identify portion 9 so as to form a measuring circuit of the resistor for type identification 4 completely electrically independent from the LED. The same reference number as that of FIG. 1 is the same functional element as that shown in FIG. 1, and a further explanation is omitted.

Figure 7:
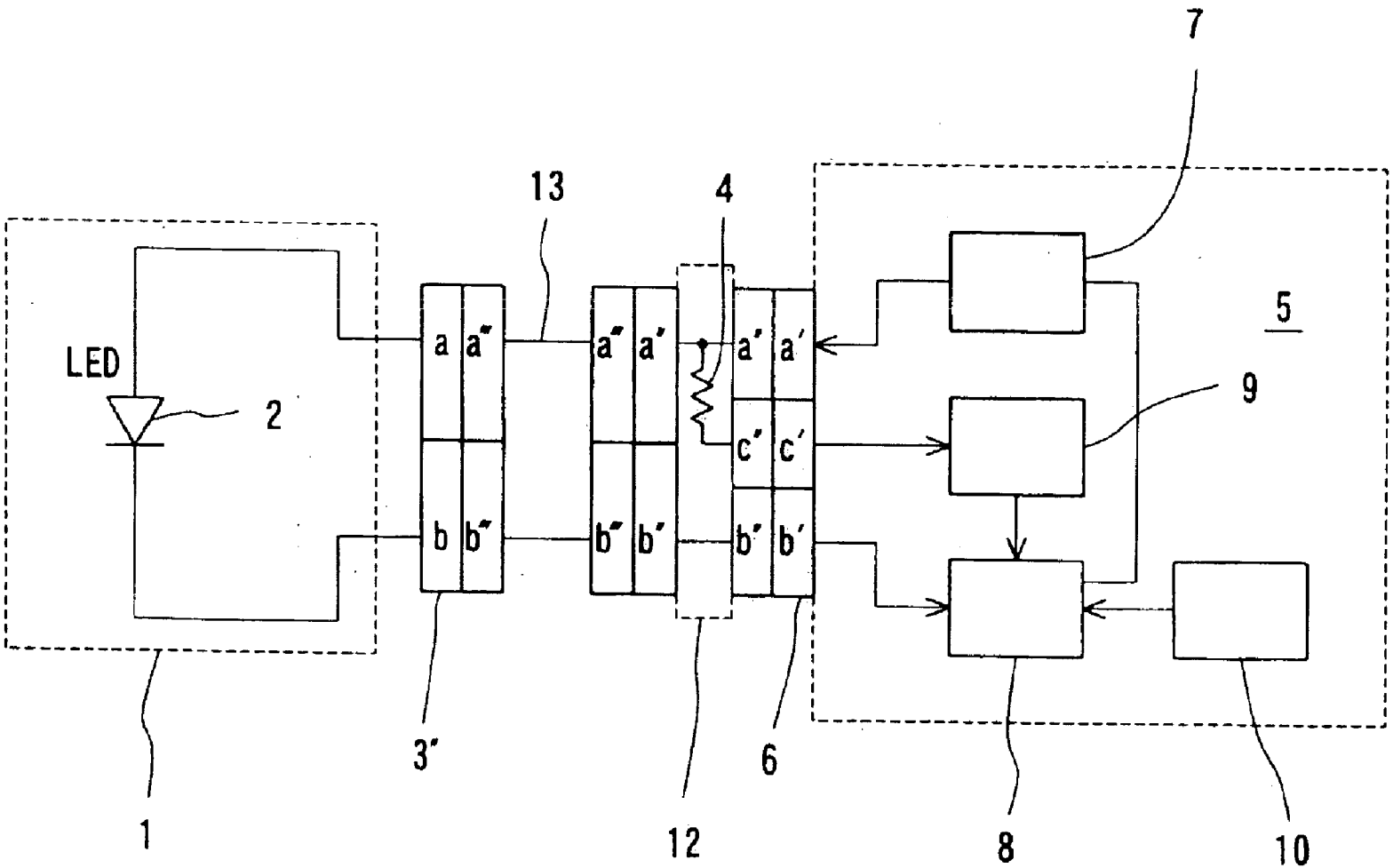
FIG. 7 is a diagram showing a modified form of a case that an adapter is arranged in the first embodiment.

FIG. 7 shows a fundamental embodiment by an adapter system. The lighting unit 1 does not include the resistor for type identification 4 and an input terminal unit 3" is provided with both terminals a and b connected with the LED conducting circuit. The arrangement of the lighting unit 1 is the same as that of a conventional lighting unit. In this embodiment a self-identify function can be produced by connecting an adapter-type transponding terminal unit 12 with the input terminal unit 3". The adapter-type transponding terminal unit 12 is electrically connected to the input terminal unit 3" through a transponding cable 13 extending between terminal configurations of the same kind.

The transponding terminal unit 12 comprises the resistor for type identification 4 having resistance corresponding to a specification or a characteristics of use of the LED conducting circuit, a pair of transponding input/output terminals a" and b" that can be connected with the both ends of the LED conducting circuit, namely, the both terminals a and b of the input terminal unit through the input/output terminals a'" and b'" of the transponding cable 13 and a terminal for measuring resistance c" connected with one end of the equipped resistor for type identification 4. Another end of the resistor for type identification 4 is, in this embodiment, connected with the input/output terminal for transponding a".

The electric power supply unit 5 is the same as that shown in FIG. 1 and acts as the same as that shown in FIG. 1. In the output terminal unit 6 a pair of the electric power supply terminals a' and b' are connected with a pair of the input/output terminals for transponding a" and b" of the transponding terminal unit 12 and the intermediate terminal c' (resistance terminal c') is connected with the terminal for measuring resistance c" in order to supply electric power to the LED conducting circuit of the lighting unit 1 through the adapter-type transponding terminal unit 12.

In case the output terminal unit 6' that is the same as that shown in FIG. 6 is used for the electric power supply unit 5, the terminal for measuring resistance c" of the adapter-type transponding terminal unit 12 is divided into two and connected with both ends of the equipped resistor for type identification 4 and a pair of the measuring input terminals c' and d' of the output terminal unit 6' are connected with the divided terminals.

FIG. 8 shows an electric power supply system for LED lighting unit arranged as a second embodiment of the present claimed invention.

The LED lighting unit 1 of this system comprises, like the above-mentioned each embodiment, the LED conducting circuit including at least an LED and the resistor for type identification 4 that has a resistor corresponding to the specification or a characteristics of use of the conducting circuit and that is connected in parallel to the conducting circuit.

The input terminal unit 3" of the lighting unit 1 is two-terminal type like the input terminal unit 3" shown in FIG. 7 and the output terminal unit 6" has a pair of the electric power supply terminals a' and b' corresponding to the two terminals a and b of the input terminal unit 3".

The type identify portion 9 of the electric power supply unit 5' is to measure a resistance of the resistor for type identification 4 through a pair of the above-mentioned electrical power supply terminals a' and b' and activated by a breaking of wiring identify portion 14. The activated breaking of wiring identify portion 9 measures a resistance of the resistor for type identification 4 that is connected in parallel by impressing a measure voltage of a level that does not affect an operation of the LED conducting circuit of the lighting unit 1 for an extremely short time. For example, in case the LED conducts electricity and emits light when a forward voltage of 2.5V is applied to the LED, the resistance of the LED is almost infinite non-conductive when a low voltage of about 1V is applied to the LED. Then if the resistance R of the resistor for type identification 4 that is connected in parallel is middle resistance of about 10 kΩ~several 10 kΩ, the resistance R can be measured without being affected by the non-conductive resistance.

When the resistance R of the resistor for type identification 4 is measured like this, a measure voltage impressed by the type identify portion 9, succeeding actuation of the type identify portion 9 is finished and then the constant current control portion 8 supplies a control current in an arbitrary range not over the maximum allowable current of the LED conducting circuit set based on the resistance R through a pair of the electric power supply terminals a' and b' of the output terminal unit 6" and the both ends a and b of the input terminal unit 3" connected to the electric power supply terminals a' and b'. The breaking of wiring identify portion 14 monitors a condition of electric power supply/a connecting condition between the LED lighting unit 1 and the electric power supply unit 5', reboots the type identify portion 9 when the condition of electric power supply/the connecting condition is broken, measures resistance of the resistor for type identification in accordance with a lighting unit succeedingly connected and gives an appropriate command to the constant current control portion 8.

FIG. 10 shows a modification of the adapter-type resistor connected in parallel. The lighting unit 1 is a conventional one that does not include the resistor for type identification 4 and produces a self-identify function to the electrical power supply by connecting an adapter-type transponding terminal 12' with the input terminal unit 3". In this case, the adapter-type transponding terminal 12' is connected with the output terminal unit 6" of the electric power supply unit 5' through a transponding cable 13' that extends between terminal configurations of the same kind.

The adapter-type transponding terminal 12' has a pair of input/output transponding terminals a" and b" that can be connected with both ends of the LED conducting circuit through the input terminal unit 3" of the lighting unit 1 and the input/output terminals a'" and b'" of the transponding cable 13 and the resistor for type identification 4 that has a resistance corresponding to a specification or a characteristics of use of the above-mentioned LED is shunting connected between the above-mentioned pair of transponding input/output terminals a" and b".

The lighting unit 5' in this embodiment is the same as that shown in FIG. 6 and acts as the same as the embodiment shown in FIG. 6 by connecting a pair of the transponding input/output terminals a" and b" of the above-mentioned adapter-type transponding terminal 12' with a pair of the electric power supply terminals a' and b'.

Next, a third embodiment will be explained with reference to FIG. 11 and FIG. 12. Reference numbers in this embodiment are irrelevant to the reference numbers of the component shown in FIG. 1 through FIG. 10.

The electric power supply system for LED lighting unit PSS in accordance with this embodiment comprises, as shown in FIG. 11, a plurality of LED lighting units 1A and 1B that illuminate a work W and electric power supply units 5A, 5A that supply electric power for each LED lighting unit 1A and 1B independently. The electric power supply system for LED lighting unit PSS is used as a component part of a work imaging system WPS that takes an image of the work W right above it with an imaging device CMR such as a CCD camera and inspects a flaw on a surface of the work W or reads a mark such as an alignment mark on the work W by image processing the image of the work W that is taken in the above process.

First, the LED lighting units 1A and 1B will be concretely explained.

In this embodiment used are a first LED lighting unit 1A that irradiates light from circumference of the work W and a second LED lighting unit 1B that irradiates light on the work W from a direction that is the same as a direction of taking an image through a half mirror HM.

The first LED lighting unit 1A has an arrangement wherein a plurality of LEDs 2A are arranged in an inward facing circle (for example, a toric shape) along a frame body 11A having a through hole in a center and an axis line J of the through hole is arranged to coincide with a center of an area monitoring the work W so that light from the LEDs 2A irradiates on the work W diagonally from a side of circumference of the work W.

The second LED lighting unit 1B has an arrangement wherein the half mirror HM arranged right above the through hole in a slanted state and a plurality of LEDs 2B arranged at a side of the half mirror HM in a shape of a sheet are retained by a hollow frame body 11B having openings both on a top face and a bottom face and light from each of the LEDs 2B reflects off the half mirror HM downward and then illuminates downward through the opening on the bottom face, namely from a direction that coincides with an axis of a direction along which an image of the work W is taken by the imaging device CMR. The reference number 16B in FIG. 11 shows an optical diffusion panel arranged between the half mirror HM and the LEDs 2B.

Like the first and the second embodiments, each of the LED lighting unit 1A, 1B is, as shown in FIG. 12, equipped with a resistor for type identification 4A, 4B that has a resistance corresponding to the specification or a characteristics of us of the LED conducting circuit including the LEDs 2A, 2B respectively. One end of the resistor for type identification 4A, 4B is connected with a constant voltage supply source CPS, CPS arranged in the electric power supply unit 5A, 5A that will be described later through a connector CN, CN and a cable 13A, 13A and the other end thereof is grounded through a fixed resistance for measurement 51A, 51A arranged in the electric power supply unit 5A, 5A so as to form a circuit network independent from the LED conducting circuit.

The imaging device CMR is to take an image of the work W lighted by the first LED lighting unit 1A and the second LED lighting unit 2A. More concretely, the imaging device CMR catches light reflecting off the work W, diffusing and then passing the through hole of the first LED lighting unit 1A, the opening on the bottom face of the second LED lighting unit 1B, the half mirror HM and the opening on the top face of the second LED lighting unit 1B.

In this embodiment the electric power supply units 5A are arranged in plural so as to correspond to a number of the LED lighting unit 1A, 1B and accommodated in a single casing CS. Each electric power supply unit 5A is connected with each of the LED lighting unit 1A (1B) through the cable 13A and the connector CN as shown by a pattern block diagram in FIG. 12. The electric power supply units 5A comprises a type identify portion 9A that measures resistance of the resistor for type identification 4A (4B) arranged in the LED lighting units 1A (1B), determines which range the measured resistance belongs to and outputs a graded judge signal S1 based on the result, a light control signal receive portion 17A that receives a light control signal S2 and a constant current control portion 8A that receives the judge signal S1, sets a maximum allowable current value based on the judge signal S1 and supplies a control current of intensity proportional to a value of the light control signal S2 within the maximum allowable current to the LED conducting circuit.

The type identify portion 9A measures resistance of the resistor for type identification 4A (4B) by measuring a potential at a connecting point P by making use of a condition that the resistor for type identification 4A (4B) arranged in the LED lighting unit 1A (1B) is connected with a fixed resistor for measurement 51A arranged in the electric power supply unit 5A in serial between a constant voltage power supply source CPS and a ground through the connector CN. More concretely, the type identify portion 9A comprises a plurality of (four, in this embodiment) comparator 91A in which a plurality of different comparison electric potentials Vref1~Vref4 are connected with one of the input terminals and the other terminal is connected with the connecting point P and a decoder 92A that decodes an output of the comparator 91A and consists of a discrete circuit with the output signal of the decoder 92A set as the judge signal S1. It is a matter of course that an A/D converter or a CPU may be used. As a result, a code (2 bits in this embodiment) as a value of the judge signal S1 shows which range the resistance of the resistor for type identification 4A (4B) belongs to. In case the resistor for type identification 4A (4B) is not arranged, the resistance is judged as infinite.

The light control signal receive portion 17A receives either one of a manual light control signal S2' controlled by a volume VL and an external light control signal S2"controlled externally selectively. The external light control signal S2" may be analog or may be a duty control pulse wave.

The constant current control portion 8A comprises a converting portion 81A that converts (attenuates) the values of the light control signal S2 (voltage values) into predetermined proportions each of which is determined based on the value of the judge signal S1 and outputs it as a converted signal S3 and an LED driving portion 82A that drives the LED conducting circuit with a control current proportional to a value of the converted signal S3.

The converting portion 81A comprises a voltage dividing portion 811A that divides the value of the light control signal S2 into a plurality of steps by serially connected plurality of resistors and outputs each of the divided signal and an analog switch ASW that selects either one of the output signals divided by the dividing portion 811A and outputs it as the converted signal S3 based on the value of the judge signal S1. The LED driving portion 82A is arranged by making use of an operational amplifier 821A and a field effective type transistor 822A and its output terminal is connected with a cathode side of the LED 2A (2B) through the connector CN and the cable 13A.

Further in this embodiment, a range switch portion 18A that makes use of a switching switch SW2 is arranged in a side of the electric power supply unit 5A. The range switch portion 18A can be switched to either one of Hi (ordinary state) and Lo (low electric power consumption state) and is so arranged that a control current having the maximum allowable current is supplied to the LED conducting circuit at a time a value of the received light control signal S2 is the maximum in case the range switch portion 18A is switched to Hi.

The range switch portion 18A is so arranged that a control current of a value smaller than the maximum allowable current is supplied to the LED conducting circuit in case the range switch portion 18A is switched to Lo even though a value of the received light control signal S2 is the maximum. More concretely, when the range switch portion 18A is switched to Lo, a dummy resistor 181A is connected with the resistor for type identification 4A (4B) in parallel, which makes the resistance of the resistor for type identification 4A (4B) measured by the type identify portion 9A apparently small. As a result, the maximum value of the control current is set to be smaller than the maximum allowable current.

In case the first LED lighting unit 1A and the second LED lighting unit 1B are arranged like the work imaging system WPS in this embodiment, the second LED lighting unit 1B does not require such a high luminous intensity, then there is no need of producing a function of the maximum lighting for the second LED lighting unit 1B. Then the electric power supply unit 5A connected with the first LED lighting unit 1A is switched to Hi, while the electric power supply unit 5A connected with the second LED lighting unit 1B is switched to Lo.

In accordance with the embodiment, since a type of the LED lighting unit 1A, 1B is automatically identified by a value of the resistor for type identification 4A, 4B and electrical power is supplied based on the identified type of the LED lighting unit 1A, 1B, a problem such as malfunction due to excessive electric power supply can effectively be avoided. In addition, it is possible to identify a type of the LED lighting unit 1A, 1B with a simple discrete circuit, thereby to make it low-cost and high in operational reliability.

Further, in case there is no need of using in a rated condition like the second LED lighting unit 1B, a problem may occur such that fine adjustment is difficult if controlled by the light control signal S2 alone. In this embodiment even though the maximum value of the control current is set at a value smaller than the maximum allowable current, namely an adjusting range is lowered with the range switching portion 18A set at Lo, adjusting resolution of the control current by the light control signal S2 is raised accordingly. As a result, fine adjustment becomes possible.

More specifically, even though a plurality of LED lighting unit 1A, 1B are required to provide the work W with an effective lighting like the work imaging system WPS and each LED lighting unit 1A, 1B is required to be used in a variety of conditions especially to adjust luminosity, it is possible for the electric power supply system for LED lighting unit PSS in accordance with this embodiment to cope with the situation fully and the effect is very remarkable.

As a modified form of this embodiment represented is, for example, the range switching portion is arranged at a side of the LED lighting unit. In addition, the range switch portion may be switched not only to two different values like the above-mentioned embodiment but also to three different values or may be switched continuously by making use of a variable resistor. It is a matter of course that an arrangement may be not only such that an apparent resistance of the resistor for type identification is changed but also such that a variable amplifier is arranged at, for example, a subsequent side of a light control signal receive portion and gain of the variable amplifier is switched. In addition, an arrangement may be such that gain of an LED driving portion is switched. If an arrangement is such that the apparent resistance of the resistor for type identification is changed like the above-mentioned embodiment, the arrangement is preferable in a way that the range switch portion can easily be arranged at a side of the LED lighting unit.

Further, in case the resistor for type identification 4A (4B) is not arranged, a type of the LED lighting unit 1A, 1B can be identified automatically with the resistance judged as infinite. As a result, for example, the resistor for identification 4A (4B) can be omitted to arrange for a type of the LED lighting unit that is shipped at the largest number, thereby to lower a manufacturing cost. It is also possible to identify a type without a resistor for type identification 4A (4B) since it has already been shipped prior to the present claimed invention.

Figure 13:
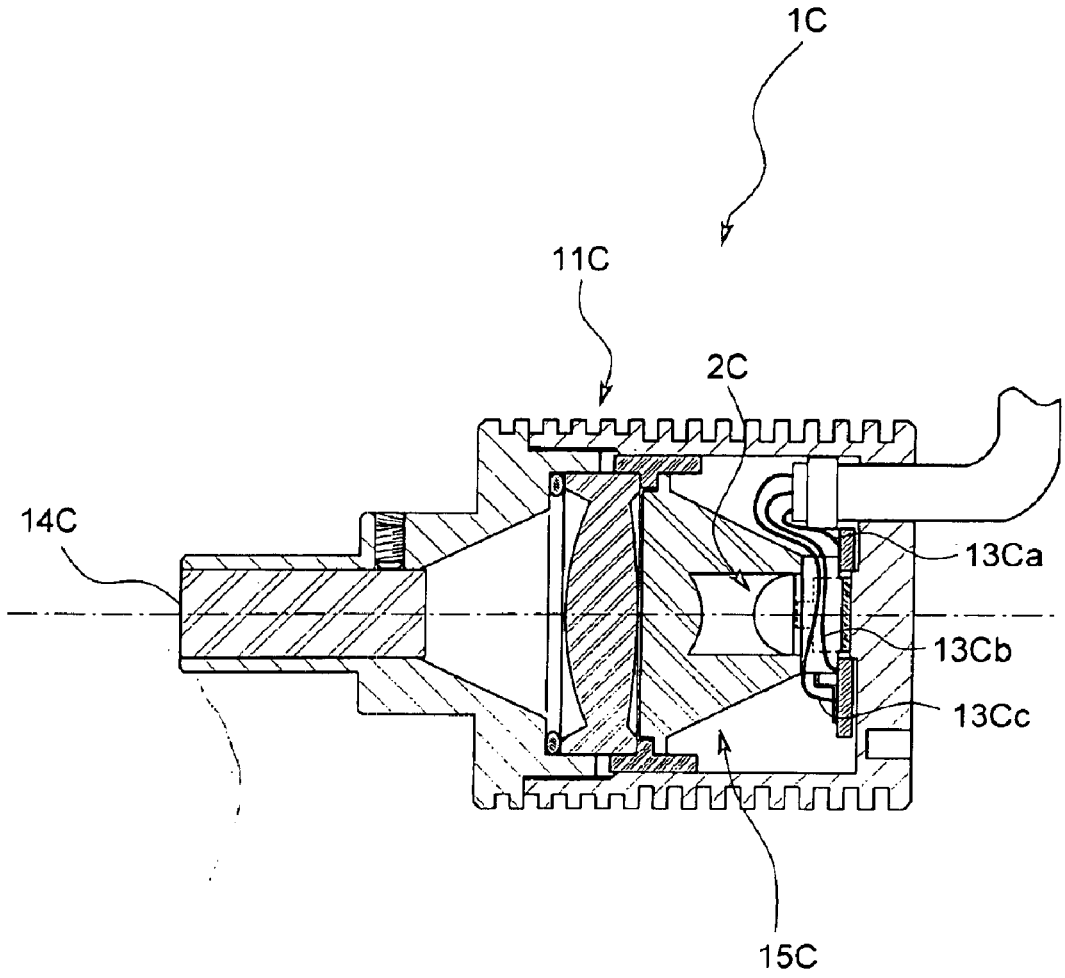
FIG. 13 is a longitudinally cross sectional view showing an internal arrangement of the LED lighting unit in the modified form of the present claimed invention.

As shown in FIG. 13, the electric power supply system for LED lighting unit in accordance with the present claimed invention may be used for an LED lighting unit 1C using a power LED that can pass an electric current of more than 200 mA continuously. The LED lighting unit 1C is so arranged that a power LED 2C and a lens mechanism 15C are incorporated into a cylindrical finned casing 11C and light is irradiated outside from a distal end face 14C. Two out of the three cables 13Ca, 13Cb, 13Cc in FIG. 13 are for electric power supply and the remaining one is connected with a resistor for type identification, not shown in drawings. If a constant voltage electric power supply is used for a lighting unit like the above, electric power consumption in an internal resistance of the electric power supply becomes big, which is not preferable. However, in accordance with a current control method like the present claimed invention it is possible to solve the problem and to produce a remarkable effect.

In addition, for example, a light control signal may be a pulse signal that controls luminosity by making use of a ratio of duty. In the above-mentioned embodiment, the pulse signal can be input as an external light control signal.

If a number of types of the LED lighting unit is large, it is a matter of course that a value to be switched of the maximum allowable current value may be changed based on the number of the type.

As mentioned above, since the electric power supply system for LED lighting unit in accordance with the present claimed invention has the above arrangement, it can recognize a type or a desired operating condition of the lighting unit automatically and supply electric power corresponding to the type or the operating condition when the lighting unit using the LED is connected to a predetermined electric power supply unit.

The electric power supply system for LED lighting unit in accordance with the present claimed invention further produces a distinguished effect, even for a conventional LED lighting unit, such that it can recognize a type or a desired operating condition of the conventional LED lighting unit automatically and supply electric power corresponding to the type or the operating condition when connected with a predetermined electric power supply unit through a predetermined adapter element.

As a result of this, the electric power supply system for LED lighting unit in accordance with the present claimed invention can cope with a plurality of types, for example about 10 types, of the LED lighting units with a single electric power supply unit.

What is claimed is:

1. An electric power supply system for LED lighting unit that constitutes a work imaging system to take an image of a work as an object to be taken by an imaging device such as a CCD camera and to process the image so as to inspect a flaw formed on a surface of the work or to read a mark such as an alignment mark, and characterized by comprising an LED lighting unit that has an LED conducting circuit including at least an LED and a resistor for type identification having resistance corresponding to a specification or a characteristics of use of the LED conducting circuit and that irradiates light on the work and an electric power supply unit that has a type identify portion consisting of a resistor measuring circuit that can be connected with the resistor for type identification and a constant current control portion that supplies a control current in an arbitrary range not over the maximum allowable current of the LED conducting circuit set based on the resistance of the resistor for type identification measured by the type identify portion to the LED conducting circuit.

2. The electric power supply system for LED lighting unit described in claim 1, further comprising a light control signal receive portion that receives a light control signal and a range switch portion that can be switched to at least two states, an ordinary state and a low electric power consumption state and so arranged that the constant current control portion supplies a control current corresponding to a value of a received light control signal to the LED conducting circuit, and so arranged in case the range switch portion is switched to the ordinary state, a control current having the maximum allowable current is supplied to the LED conducting circuit when a value of the received light control signal is the maximum, meanwhile in case the range switch portion is switched to the low electric power consumption state, a control current smaller than the maximum allowable current is supplied to the LED conducting circuit even though a value of the received light control signal is the maximum.

3. The electric power supply system for LED lighting unit described in claim 1, wherein the maximum allowable current can be set in a graded manner based on resistance of the resistor for type identification.

4. An electric power supply system for LED lighting unit characterized by comprising an LED lighting unit that has an LED conducting circuit including at least an LED and a resistor for type identification having resistance corresponding to a specification or a characteristics of use of the LED conducting circuit and an electric power supply unit that supplies electric power to the LED conducting circuit of the LED lighting unit and that has a type identify portion consisting of a resistor measuring circuit that can be connected with the resistor for type identification and a constant current control portion that supplies a control current in an arbitrary range not over the maximum allowable current of the LED conducting circuit set based on the resistance of the resistor for type identification measured by the type identify portion to the LED conducting circuit.

5. The electric power supply system for LED lighting unit described in claim 4, further comprising a light control signal receive portion that receives a light control signal and a range switch portion that can be switched to at least two states, an ordinary state and a low electric power consumption state and so arranged that the constant current control portion supplies a control current corresponding to a value of a received light control signal to the LED conducting circuit, and so arranged in case the range switch portion is switched to the ordinary state, a control current having the maximum allowable current is supplied to the LED conducting circuit when a value of the received light control signal is the maximum, meanwhile in case the range switch portion is switched to the low electric power consumption state, a control current smaller than the maximum allowable current is supplied to the LED conducting circuit even though a value of the received light control signal is the maximum.

6. The electric power supply system for LED lighting unit described in claim 4, wherein the maximum allowable current can be set in a graded manner based on resistance of the resistor for type identification.

7. An electric power supply system for LED lighting unit characterized by comprising an LED lighting unit that has an LED conducting circuit including at least an LED and a resistor for type identification having resistance corresponding to a specification or a characteristics of use of the LED conducting circuit and connected with the LED conducting circuit in parallel and an electric power supply unit consisting of a constant current supply unit that can be connected with the LED conducting circuit in order to supply electric power to the LED conducting circuit of the LED lighting unit and that comprises a type identify portion to measure resistance of the resistor for type identification by impressing a measure voltage of a level that does not affect an operation of the LED conducting circuit to the resistor for type identification connected with the LED conducting circuit for an extremely short time, a constant current control portion that supplies a control current in an arbitrary range not over the maximum allowable current of the LED conducting circuit set based on the resistance of the resistor for type identification that is connected in parallel that is measured by the type identify portion to the LED conducting circuit after the measure voltage is impressed, and a breaking of wiring identify portion that monitors a condition of electric power supply/a connecting condition between the LED lighting unit and the electric power supply unit and that reboots the type identify portion when the condition of electric power supply/the connecting condition is broken.

8. The electric power supply system for LED lighting unit described in claim 7, further comprising a light control signal receive portion that receives a light control signal and a range switch portion that can be switched to at least two states, an ordinary state and a low electric power consumption state and so arranged that the constant current control portion supplies a control current corresponding to a value of a received light control signal to the LED conducting circuit, and so arranged in case the range switch portion is switched to the ordinary state, a control current having the maximum allowable current is supplied to the LED conducting circuit when a value of the received light control signal is the maximum, meanwhile in case the range switch portion is switched to the low electric power consumption state, a control current smaller than the maximum allowable current is supplied to the LED conducting circuit even though a value of the received light control signal is the maximum.

9. The electric power supply system for LED lighting unit described in claim 7, wherein the maximum allowable current can be set in a graded manner based on resistance of the resistor for type identification.

* * * * *